US009016820B2

(12) United States Patent
Uchida

(10) Patent No.: US 9,016,820 B2
(45) Date of Patent: Apr. 28, 2015

(54) PRINTING APPARATUS AND CONTROL METHOD THEREOF

(75) Inventor: Naoki Uchida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 96 days.

(21) Appl. No.: 13/565,156

(22) Filed: Aug. 2, 2012

(65) Prior Publication Data

US 2013/0050324 A1 Feb. 28, 2013

(30) Foreign Application Priority Data

Aug. 24, 2011 (JP) ..... 2011-183077

(51) Int. Cl.
*B41J 29/38* (2006.01)
*B41J 2/21* (2006.01)

(52) U.S. Cl.
CPC ..... *B41J 29/38* (2013.01); *B41J 2/2139* (2013.01)

(58) Field of Classification Search
CPC ..... B41J 29/38
See application file for complete search history.

(56) References Cited

U.S. PATENT DOCUMENTS 6,092,939 A 7/2000 Nishikori et al.
6,755,499 B2 6/2004 Castano et al.
6,769,759 B2 * 8/2004 Yamasaki et al. ..... 347/41
7,322,663 B2 * 1/2008 Sanada ..... 347/10
7,517,038 B2 * 4/2009 Otsuki ..... 347/14
2004/0196325 A1 10/2004 Castano et al.
2009/0237437 A1 9/2009 Uchida
2010/0289843 A1 * 11/2010 Tomizawa et al. ..... 347/14
2012/0169810 A1 7/2012 Nishioka et al.

FOREIGN PATENT DOCUMENTS

JP 10-329381 A 12/1998
JP 2002-361965 A 12/2002

OTHER PUBLICATIONS

English translation of JP 2002-361965.

* cited by examiner

*Primary Examiner* — Manish S Shah
*Assistant Examiner* — Jeremy Delozier
(74) *Attorney, Agent, or Firm* — Fitzpatrick, Cella, Harper & Scinto

(57) ABSTRACT

A printing apparatus includes a printhead having a first nozzle array and a second nozzle array for discharging ink, a reading unit, a first obtaining unit configured to obtain first information about a shift amount between printing positions for the first and second nozzle arrays, a print control unit configured to print first and second distance detection patterns with the first and second nozzle arrays, a second obtaining unit configured to obtain second information about a distance between printing positions of the first and second distance detection patterns in accordance with a result of the first and second distance detection patterns, and a determination unit configured to determine an ink discharge timing in accordance with the first and second information.

21 Claims, 13 Drawing Sheets

PRINTING APPARATUS AND CONTROL METHOD THEREOF

BACKGROUND OF THE INVENTION

1. Field of the Invention

The present invention relates to a printing apparatus and control method thereof.

2. Description of the Related Art

An inkjet printing apparatus cannot obtain a high-quality image unless a plurality of ink droplets land at correct positions on a printing medium (for example, paper), and form dots on the printing medium in a relatively correct array.

However, the ink landing position varies owing to various errors contained in the printing apparatus. To correct the ink landing position, it is well known to adjust the discharge timing.

As a method of obtaining discharge timing information for correcting the ink landing position, a technique which pays attention to overlapping of printing patterns has been disclosed (see Japanese Patent Laid-Open No. 10-329381). There has also been disclosed a technique of obtaining discharge timing information by measuring a distance between a reference pattern and an adjustment pattern (see Japanese Patent Laid-Open No. 2002-361965).

In the technique disclosed in Japanese Patent Laid-Open No. 10-329381, the printing resolution of the adjustment pattern defines a resolution which can be obtained by correction of the ink landing position. In this arrangement, the printing area becomes large when ink landing position information is obtained at high accuracy in a wide range.

The technique disclosed in Japanese Patent Laid-Open No. 2002-361965 can correct the ink landing position even if the printing area is small. However, the reference pattern and adjustment pattern are not printed at the same position on a printing medium, and are affected by variations of the ink landing position dependent on the printing position.

SUMMARY OF THE INVENTION

The present invention provides a technique advantageous to improving the ink landing position adjustment accuracy while suppressing the amount of ink used in adjustment of the ink landing position.

One of the aspects of the present invention provides a printing apparatus comprising a printhead configured to arrange, in a predetermined direction, a first nozzle array and second nozzle array for discharging ink onto a printing medium, a reading unit, a first obtaining unit configured to obtain, for each of a plurality of positions on the printing medium in a predetermined direction, first information about a shift amount between a printing position of ink discharged from the first nozzle array and a printing position of ink discharged from the second nozzle array, a print control unit configured to print a first distance detection pattern on the printing medium by discharging ink from the first nozzle array and to print a second distance detection pattern at a position spaced apart from the first distance detection pattern in the predetermined direction by discharging ink from the second nozzle array, a second obtaining unit configured to obtain, based on a result of reading the first distance detection pattern and the second distance detection pattern by the reading unit, second information about a distance between a printing position of the first distance detection pattern and a printing position of the second distance detection pattern, and a determination unit configured to determine, based on the first information obtained by the first obtaining unit and the second information obtained by the second obtaining unit, an ink discharge timing of the second nozzle array for correcting a shift of an ink printing position of the second nozzle array from an ink printing position of the first nozzle array.

Further features of the present invention will become apparent from the following description of exemplary embodiments with reference to the attached drawings.

DESCRIPTION OF THE EMBODIMENTS

Preferred embodiments of the present invention will now be described in detail with reference to the accompanying drawings. In the following description, a printing apparatus using an inkjet printing method will be exemplified. The printing apparatus may be, for example, a single-function printer having only a printing function, or a multifunction printer having a plurality of functions including a printing function, FAX function, and scanner function. Also, the printing apparatus may be, for example, a manufacturing apparatus used to manufacture a color filter, electronic device, optical device, micro-structure, and the like using a predetermined printing system.

In this specification, "printing" means not only forming significant information such as characters or graphics but also forming, for example, an image, design, pattern, or structure on a printing medium in a broad sense regardless of whether the formed information is significant, or processing the medium as well. In addition, the formed information need not always be visualized so as to be visually recognized by humans.

Also, a "printing medium" means not only a paper sheet for use in a general printing apparatus but also a member which can fix ink, such as cloth, plastic film, metallic plate, glass, ceramics, resin, lumber, or leather in a broad sense.

Also, "ink" should be interpreted in a broad sense as in the definition of "printing" mentioned above, and means a liquid which can be used to form, for example, an image, design, or pattern, process a printing medium, or perform ink processing upon being supplied onto the printing medium. The ink processing includes, for example, solidification or insolubilization of a coloring material in ink supplied onto a printing medium.

Figure 1A:
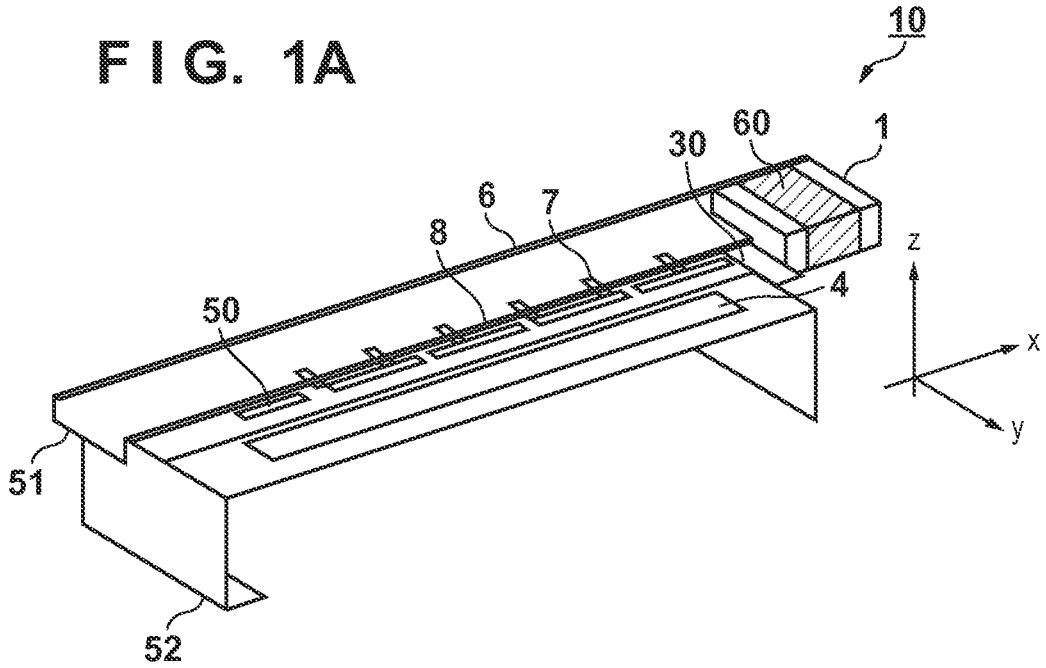
FIGS. 1A and 1B are perspective views exemplifying the outer appearance of a printing apparatus according to an embodiment of the present invention.
Figure 1B:
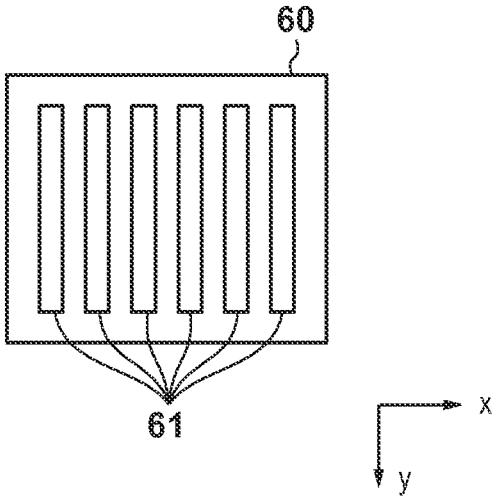

FIGS. 1A and 1B are perspective views exemplifying the outer appearance of a printing apparatus according to an embodiment of the present invention. A color inkjet printing apparatus will be exemplified. FIG. 1A is a perspective view showing a state in which a front cover is removed to expose the inside of the apparatus.

In an inkjet printing apparatus (to be referred to as a printing apparatus hereinafter) 10, an inkjet printhead (to be referred to as a printhead hereinafter) 60 which prints by discharging ink according to the inkjet method is mounted on a carriage 1. The printhead 60 includes nozzle arrays 61 in which a plurality of nozzles are arrayed. The printing apparatus 10 prints by reciprocating the carriage 1 in the x direction (main scanning direction: direction intersecting a printing medium conveyance direction). In the printhead 60, a plurality of nozzle arrays 61 are arranged in the x direction. The printing apparatus 10 conveys a printing medium (paper in the embodiment) up to a printing start position. At the printing start position, the printing apparatus 10 prints by discharging ink from the printhead 60 onto the printing medium.

An optical sensor 30 is a reflection optical sensor and is arranged on the carriage 1. The optical sensor 30 has a function of detecting the density and end of an adjustment pattern formed on a printing medium when detecting the shift amount of an ink landing position on a printing medium.

By combining scanning (movement in the main scanning direction: x direction) of the carriage and the conveyance operation (conveyance in the sub scanning direction: y direction) of a printing medium, the optical sensor 30 can arbitrarily detect the density of an adjustment pattern formed on the printing medium. Note that the optical sensor 30 may be used to detect the end of paper.

The carriage 1 reciprocates in the main scanning direction using a carriage motor (not shown). The printing apparatus 10 includes a carriage belt for transferring power of the carriage motor to the carriage 1. A main rail 8 is arranged in the main scanning direction of the carriage 1. The main rail 8 supports the carriage 1 and guides its movement. A sub-rail 6 is arranged parallel to the main rail 8 in order to hold the orientation of the carriage 1. A support member 7 supports the main rail 8. A carriage encoder scale 14 (not shown) has slits (slit pattern) for detecting the moving amount and position of the carriage 1, and is arranged parallel to the main rail 8.

The main rail 8, the sub-rail 6, a front cover (not shown), and the like are attached to an upper housing 51. The upper housing 51 forms the housing of the printing apparatus 10 together with a lower housing 52 to which a platen 4, a conveyance roller (not shown), and the like are attached. A mist suction hole 50 recovers a mist generated upon discharging an ink droplet.

Figure 2:
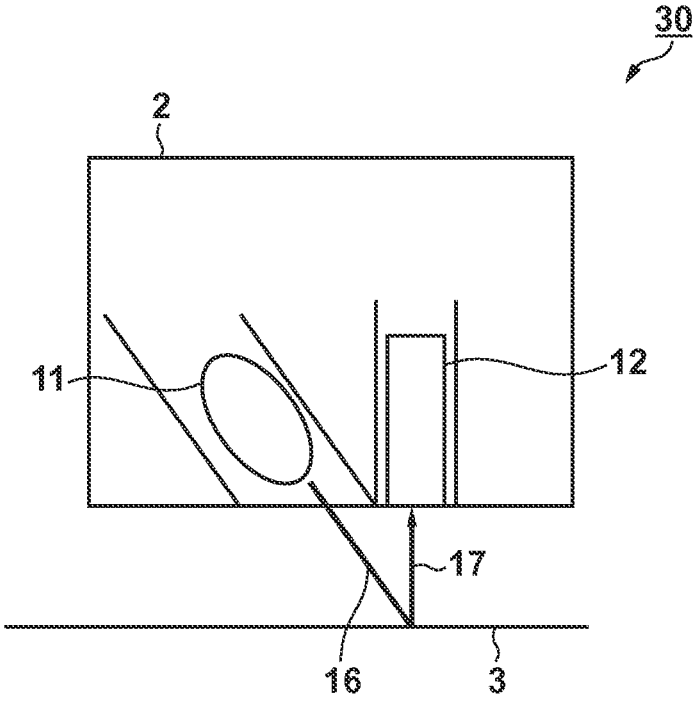
FIG. 2 is a view exemplifying the schematic arrangement of an optical sensor 30.

The schematic arrangement of the optical sensor 30 shown in FIG. 1A will be exemplified with reference to FIG. 2.

The optical sensor 30 includes a light emitting unit 11 and light receiving unit 12. Irradiation light 16 emitted by the light emitting unit 11 is reflected by the surface of a printing medium 3. Reflected light 17 includes specular reflection and diffused reflection. To more accurately detect the density of an image formed on the printing medium 3, diffused reflection light is desirably detected. For this purpose, the light receiving unit 12 is arranged at an angle different from the incident angle of light from the light emitting unit 11. A detection signal obtained from the light receiving unit 12 is transmitted to the electric board of the printing apparatus 10.

A case in which registration adjustment is performed for the printhead 60 configured to discharge all inks including C, M, Y, and K main inks and spot color inks will be explained. The light emitting unit 11 suffices to use a white LED (Light Emitting Diode) or three-color LED. The light receiving unit 12 suffices to use a photoelectric converter having sensitivity in the visible light range. When detecting the relationship between relative printing positions in overlay printing and densities, adjustment between different colors needs to be executed. In this case, it is more desirable to use the three-color LED capable of selecting a color with high detection sensitivity.

When detecting the density of an image formed on the printing medium 3, the absolute value of the density need not be detected, and it suffices to detect a relative density. A mechanism of detecting a density suffices to have a detection resolution capable of detecting a relative density difference in each pattern (one pattern contained in an adjustment pattern will be called a patch) belonging to an adjustment pattern group (to be described later).

The stability of the detection system including the optical sensor 30 suffices not to affect a detected density difference till the end of detecting all the adjustment pattern group. The sensitivity is adjusted by moving the optical sensor 30 to a non-printing portion of paper. As the adjustment method, the emission intensity of the light emitting unit 11 is adjusted so that the detection level reaches an upper limit value, or the gain of a detection amplifier is adjusted in the light receiving unit 12. Note that sensitivity adjustment is not essential, but is effective for increasing the S/N ratio and the detection accuracy.

The spatial resolution of the optical sensor 30 is desirably a resolution high enough to detect a region smaller than the printing region of one adjustment pattern. For example when an adjustment pattern group is printed so that two pattern groups are adjacent to each other in the main scanning direction and sub scanning direction in multi-pass printing, the printing width in the sub scanning direction decreases in accordance with the number of passes. Hence, the sensor resolution is restricted by the number of printing passes. The number of printing passes (printing width) to print an adjustment pattern may be determined from the sensor resolution.

Figure 3:
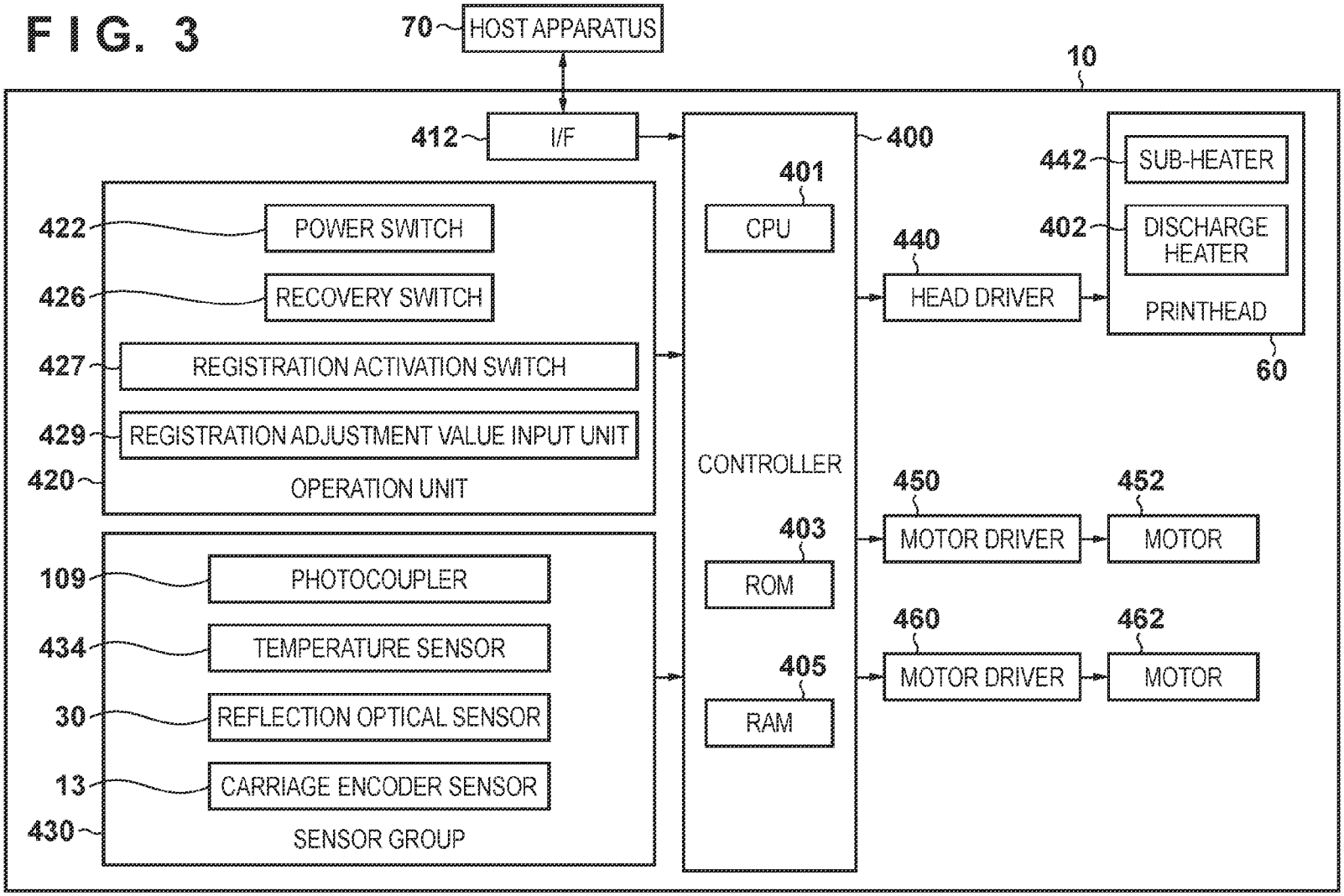
FIG. 3 is a block diagram exemplifying the arrangement of the control system of a printing apparatus 10.

The arrangement of the control system of the printing apparatus 10 shown in FIG. 1A will be exemplified with reference to FIG. 3.

Prior to a description of the printing apparatus 10, a host apparatus 70 will be explained briefly. The host apparatus 70 is implemented by a computer (or an image reader or digital camera) serving as an image data supply source.

The printing apparatus 10 includes, as the building components of the control system, an I/F (InterFace) 412, a controller 400, an operation unit 420, a sensor group 430, various drivers 440, 450, and 460, various motors 452 and 462, and the printhead 60.

The I/F 412 transmits/receives image data, other commands, status signals, and the like to/from the host apparatus 70. The I/F 412 transfers the received data and the like to the controller 400.

The controller 400 executively controls operations in the printing apparatus 10. The controller 400 includes, for example, a CPU (Central Processing Unit) 401, ROM (read Only Memory) 403, and RAM (Random Access Memory) 405. The CPU 401 executively controls various processes in accordance with programs stored in the ROM 403 and the like. The ROM 403 stores programs, necessary tables, and other data. The RAM 405 is used as an area for rasterizing image data, a work area, and the like. The controller 400 controls an image printing operation based on image data, and controls printing position adjustment processing (to be described later). The controller 400 controls the driving timing (ink discharge timing) of the printing element of the printhead based on an adjustment amount (ink landing position shift correction value) obtained by printing position adjustment processing.

The operation unit 420 is implemented by an operator panel or the like, and inputs an instruction from the user into the apparatus. The operation unit 420 includes, for example, a power switch 422 for designating power ON/OFF, and a recovery switch 426 for designating activation of suction recovery. The operation unit 420 also includes, for example, a registration adjustment activation switch 427 for manually performing registration adjustment, and a registration adjustment value setting input unit 429 for manually inputting an adjustment value. Printing position adjustment processing is executed in accordance with an input from the operation unit 420.

The sensor group 430 detects an apparatus state. The sensor group 430 includes, for example, the optical sensor 30, a photocoupler 109 for detecting a home position, a temperature sensor 434 for detecting an ambient temperature, and a carriage encoder sensor 13. The carriage encoder sensor 13 reads the slits of the carriage encoder scale 14 (see FIG. 7A). The carriage encoder sensor 13 outputs a signal to the controller 400 in accordance with movement of the printhead 60 and optical sensor 30. The temperature sensor 434 is properly arranged at a predetermined portion in the printing apparatus 10.

The head driver 440 drives discharge heaters in the printhead 60 in accordance with printing data. The head driver 440 corresponds to, for example, a shift register which arranges printing data in correspondence with the positions of the discharge heaters, and a latch circuit which latches the printing data at a predetermined timing. Further, the head driver 440 includes a logic circuit element which operates the discharge heater in synchronism with a driving timing signal, and a timing setting unit which appropriately sets a driving timing (discharge timing) to adjust a dot formation position. Note that part of the head driver 440 may be arranged in the printhead 60.

The printhead 60 includes discharge heaters (printing elements) 402 for respective nozzles. The discharge heater 402 is a heater which generates thermal energy for discharging ink. The printhead 60 also includes sub-heaters 442. The sub-heater 442 is a heater which adjusts the temperature of the printhead to stabilize the ink discharge characteristic.

The motor driver 450 drives the main scanning (carriage) motor 452 to reciprocate the carriage (in the main scanning direction). The motor driver 460 drives the sub-scanning (LF) motor 462 to convey a printing medium (in the sub scanning direction).

To facilitate a description of an ink landing position adjustment method according to the embodiment, a conventional problem will be explained.

When a method of detecting a distance between ink landing positions is used to obtain ink landing positions on a printing medium, a reference pattern and adjustment pattern are printed at different positions in the main scanning direction. These patterns are printed at almost the same position in the main scanning direction, and even a small shift amount between these patterns can be detected using a high-resolution detector such as a microscope. However, it is difficult to implement this by a low-cost arrangement.

It is therefore necessary to print a reference pattern and adjustment pattern at different positions in the main scanning direction. However, when these patterns are printed at different positions in the main scanning direction, an ink landing position shift arising from the positional difference is added to an ink landing position shift amount to be originally adjusted.

Figure 4:
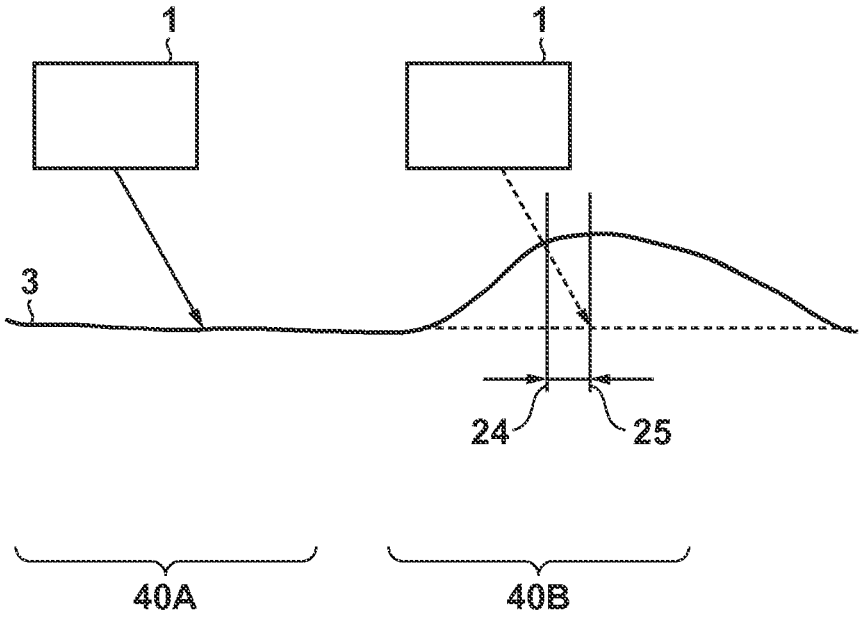
FIG. 4 is a schematic view exemplifying a change of the ink landing position in the main scanning direction.

An outline of a change of the ink landing position in the main scanning direction will be described with reference to FIG. 4. Reference numeral 1 denotes a carriage; 3, a printing medium (in this case, paper); 24, an actual ink landing position; and 25, an assumed ink landing position.

In a region 40A on the printing medium in the main scanning direction, ink is expected to land at an assumed position. However, in a region 40B, an actual ink landing position may shift from an assumed position because the distance between the head and paper has changed. The ink landing position shift component is generated even if the same nozzle is used.

Assume that a reference pattern is printed in the region 40A on the printing medium using a reference nozzle array, an adjustment pattern is printed in the region 40B on the printing medium using an adjustment nozzle array (nozzle array to be adjusted), and the ink landing position shift amount is calculated based on the distance between the patterns.

In this case, a shift amount obtained by adding both an ink landing position shift amount (shift amount to be originally adjusted) by the adjustment nozzle array, and an ink landing position shift amount arising from the positional difference between the two patterns in the main scanning direction is calculated. Even if the discharge timing is adjusted based on the calculated shift amount, the ink landing position by the reference nozzle array and the ink landing position by the adjustment nozzle array do not coincide with each other.

The following embodiments will describe a technique for solving this problem. More specifically, a method of reducing an adjustment value error arising from the distance between the head and paper at each position in the main scanning direction will be explained.

First Embodiment

The first embodiment will be described. The sequence of printing position adjustment (ink landing position adjustment) processing in a printing apparatus 10 shown in FIG. 1A will be explained with reference to FIG. 5.

[Step S101]

In the printing apparatus 10, first, a CPU 401 reads out, from a RAM 405, information about an ink landing position at each position in the main scanning direction, and obtains an ink landing position shift amount. This information is stored in advance in the RAM 405. This information is stored in the RAM 405 in assembly of the printing apparatus in the factory, which will be described later. In the factory, a test pattern is printed and read, and information about the ink landing position is obtained based on the result.

Figure 6A:
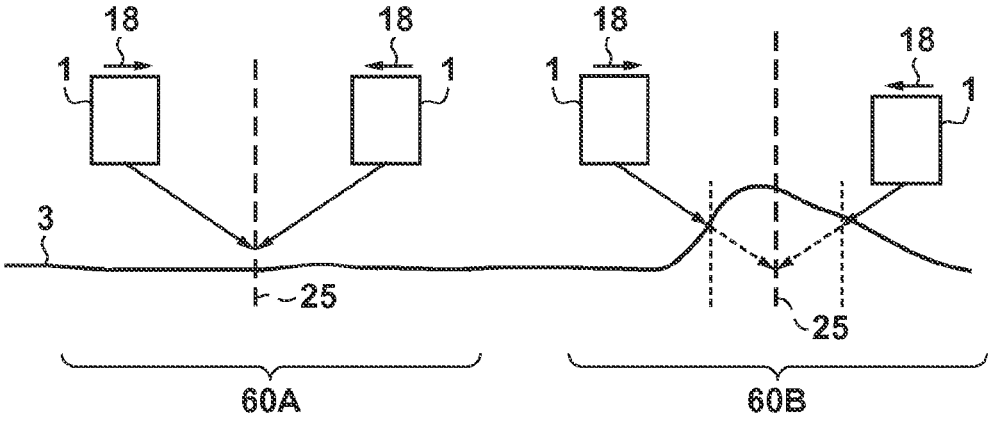
FIG. 6A is a schematic view exemplifying a change of the ink landing position in the main scanning direction.

An example of obtaining the information about the ink landing position will be explained. As described above, the ink landing position shifts at each position in the main scanning direction. FIG. 6A is a schematic view showing an ink landing position when the distance between the head and paper varies. Reference numeral 1 denotes a carriage; 3, a printing medium; 18, carriage traveling directions (there are two directions because of bidirectional printing); and 25, a target ink landing position.

Assume that an appropriate discharge timing for the target ink landing position 25 is determined based on a printing result obtained in a state 60A of FIG. 6A, and printing is performed at the determined discharge timing in a state 60B of FIG. 6A. In this case, the distance between the head and paper differs between the states 60A and 60B, so the ink landing position shifts. Especially when adjusting an ink landing position in bidirectional printing, the ink landing position shifts owing to variations of the distance between the head and paper. Hence, when calculating an adjustment value, variation information about the distance between the head and paper in the main scanning direction is obtained. Based on this information, an ink landing position shift amount at each position in the main scanning direction is obtained. The shift amount is obtained for each nozzle array.

For example, a case in which a test pattern is printed in the forward and reverse directions will be examined. In this case, an ink landing position shift amount generated on forward and reverse passes at a predetermined position in the main scanning direction is calculated according to equation (1):

$$R=h/v\times Vcr\times 2 \quad (1)$$

R: ink landing position shift amount at a predetermined position, h: variation amount of the distance between the head and paper, v: discharge speed, Vcr: carriage speed, ×2: double because of reciprocal printing For example, when the variation amount of the distance between the head and paper is 0.2 mm, the discharge speed is 18 m/s, and the carriage speed is 33.3 inches/s, the reciprocal ink landing position shift amount is about 18 μm. Thus, the ink landing position shift amount R at the predetermined position can be calculated to be 18 μm. Note that an optical sensor 30 (see FIG. 2) mounted on the carriage 1 can measure the variation amount h of the distance between the head and paper.

[Step S102]

In the printing apparatus 10, the CPU 401 controls a discharge operation of a printhead 60 via a head driver 440 (that is, controls printing). In response to this, the printhead 60 discharges ink, printing a reference pattern and adjustment pattern on a printing medium. The reference pattern is printed using the reference nozzle array of the printhead 60, and the adjustment pattern is printed using the adjustment nozzle array (nozzle arrays to be adjust) of the printhead 60. The reference pattern and adjustment pattern will be referred to as distance detection patterns or position detection patterns. These patterns may be printed by nozzles arranged at arbitrary positions in the printhead 60, but are desirably printed by the same (or close) nozzles in order to reduce the variation amount. Also, these patterns are desirably printed on the same pass in order to reduce the influence of variations of the conveyance amount in the sub scanning direction.

[Step S103]

The printing apparatus 10 reads the reference pattern and adjustment pattern printed on the printing medium using the optical sensor 30 under the control of the CPU 401. The printing apparatus 10 detects the distance between the patterns in the main scanning direction using a carriage encoder sensor 13. That is, the ink landing position shift amount is obtained based on the detection result from the optical sensor 30.

Figure 6B:
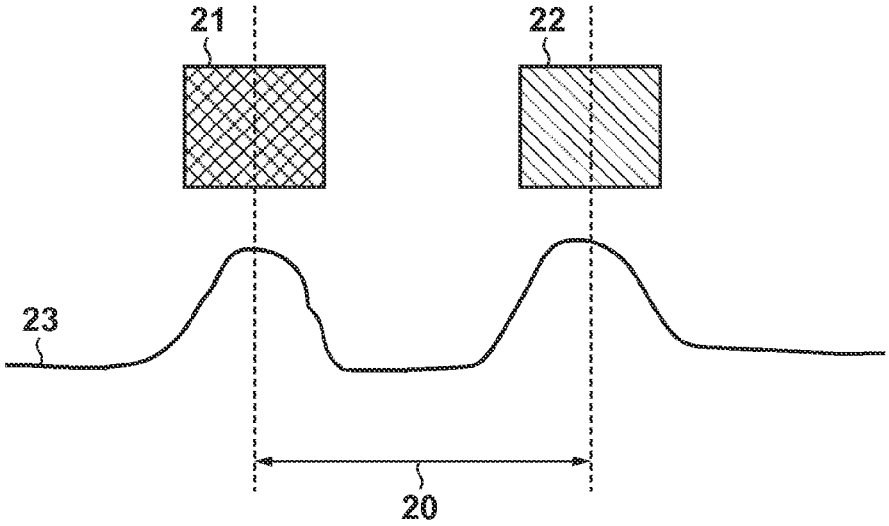
FIG. 6B is a schematic view exemplifying a change of the ink landing position in the main scanning direction.

A method of calculating an ink landing position shift amount based on the distance between patterns will be described with reference to FIG. 6B. Here, a method of calculating an ink landing position shift amount based on the detection result of the distance between the head and paper by the optical sensor 30 will be explained. Reference numeral 20 denotes a detected distance; 21, a reference pattern; 22, an adjustment pattern; and 23, an output result from the optical sensor 30.

First, the CPU 401 obtains the slit position (slit count) of the carriage encoder scale when printing the adjustment pattern 22 with respect to the reference pattern 21. Then, the CPU 401 obtains the detection results (output results) of the reference pattern 21 and adjustment pattern 22 by the optical sensor 30 mounted on the carriage 1. Since an output from the optical sensor 30 changes between the non-printing region and the printing region, the output changes in a region where a pattern is printed.

The CPU 401 calculates center positions as the representative points of output changes in the respective patterns. This calculation is performed based on the slit position (slit count) detected by the carriage encoder sensor in detection by the optical sensor 30. As described above, the optical sensor 30 obtains diffused reflection of light entering the printing medium. By obtaining the diffused reflection, even if the distance between the head and paper varies, variations of the sensor output can be reduced. The pattern detection position need not always be the center.

After that, the CPU 401 detects an ink landing position shift amount based on the distance between the calculated centers and the slit position of the carriage encoder scale in pattern printing. The ink landing position shift amount is calculated according to equation (2):

$$L=Ld-\text{Penc} \quad (2)$$

L: ink landing position shift amount, Ld: distance between the detected centers, Penc: slit position (distance between the reference pattern and the adjustment pattern) of the carriage encoder scale in printing For example, when the slit position (distance between the reference pattern and the adjustment pattern) of the carriage encoder scale is 10.016 mm and the distance between the centers is 10.008 mm, the ink landing position shift amount is about −8 μm.

[Step S104]

In the printing apparatus 10, the CPU 401 calculates a (final) ink landing position shift amount based on the information obtained in the processing of step S101 and the information obtained in the processing of step S103, and calculates an adjustment value for correcting the shift amount. More specifically, the adjustment value is calculated using the information (ink landing position shift amount) about an ink landing position at each position in the main scanning direction, and the ink landing position shift amount based on the distance between the patterns. In the printing apparatus 10, an ink landing position shift is corrected by adjusting the timing of discharge from the adjustment nozzle array based on the adjustment value.

In this case, $$Cg=R-L \quad (3)$$

Cg: adjustment value, R: ink landing position shift amount (obtained in the processing of step S101) at a predetermined position, L: ink landing position shift amount (obtained in the processing of step S103)

In the embodiment, Cg is about 26 μm.

In the above description, the ink landing position at each position in the main scanning direction shifts owing to height variations (variations of the distance between the head and paper). However, the ink landing position shifts due to other factors. Some of these factors will be exemplified.

Figure 7A:
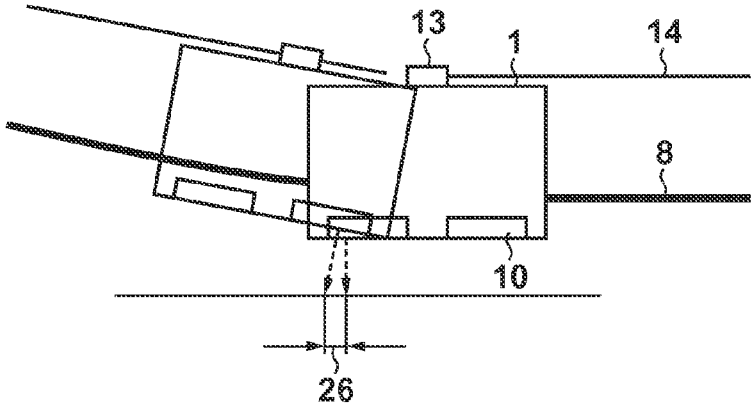
FIG. 7A is a schematic view exemplifying a change of the ink landing position in the main scanning direction.

The first example of generating an ink landing position shift is orientation variations of the carriage 1. FIG. 7A exemplifies an ink landing position when the orientation varies while the carriage 1 moves in the main scanning direction. Reference numeral 1 denotes a carriage; 8, a main rail; 10, a nozzle; 13, a carriage encoder sensor; 14, a carriage encoder scale; and 26, an ink landing position shift amount generated by orientation variations.

A plurality of nozzle arrays are arranged in the sub scanning direction on the printhead 60. Nozzle arrays of the same color are arranged to be adjacent to each other. When the orientation of the carriage 1 varies in the main scanning direction, the ink landing position shifts in overlay of inks from nozzles of different colors owing to the difference between the arrangement positions of nozzles used for printing. This is because the positions of nozzles used for printing are different, and the discharge timings are different even in printing at the same position.

The position where the orientation of the carriage 1 varies depends on the position of the carriage 1 in the main scanning direction. Thus, the ink landing position also shifts depending on the position of the carriage 1 in the main scanning direction. The ink landing position shift amount depending on orientation variations of the carriage 1 can be obtained by specifying the orientation variation amount of the carriage 1 at each position of the carriage 1 in the main scanning direction. The orientation variation amount of the carriage 1 highly depends on the accuracy of the main rail 8 and arises from the manufacturing accuracy. For this reason, the orientation variation amount of the carriage 1 may be detected in the manufacture of the main body or obtained before printing adjustment.

The second example of generating the above-mentioned ink landing position shift is expansion and contraction of a printing medium upon landing of ink on the printing medium (to be also referred to as cockling hereinafter).

Figure 7B:
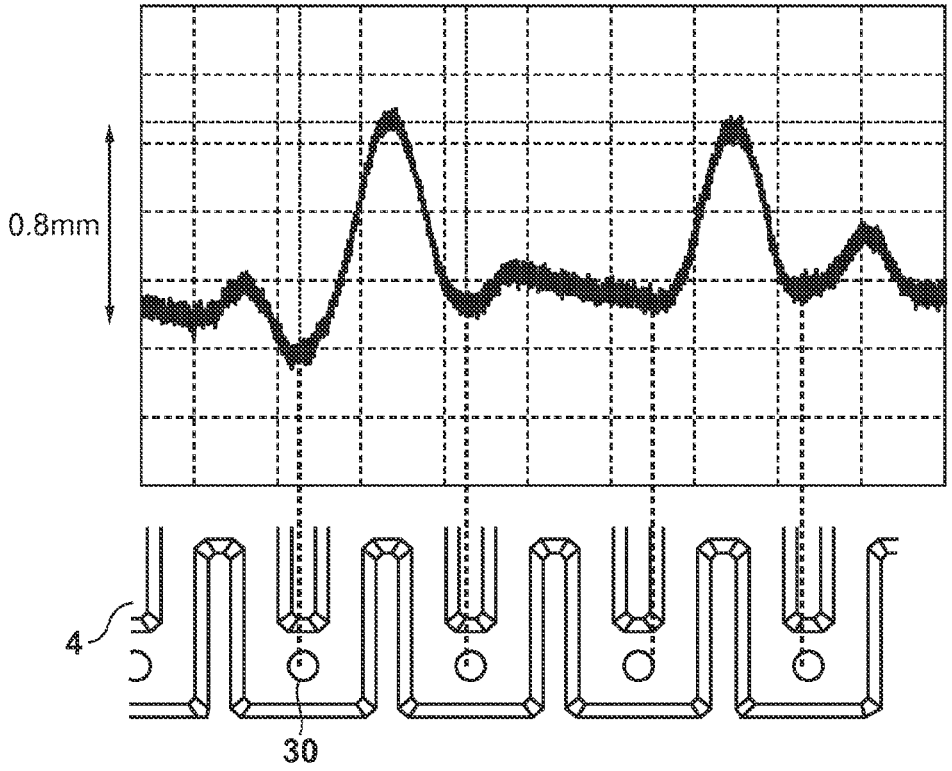
FIG. 7B is a schematic view exemplifying a change of the ink landing position in the main scanning direction.

FIG. 7B is a view exemplifying a change of the surface state (paper surface state in this case) of a printing medium caused by cockling. Reference numeral 4 denotes a platen; and 30, a suction port of the platen.

When the printing apparatus adopts a suction platen, cockling occurs depending on the suction port. If cockling occurs, the printing medium varies with respect to the platen, the distance between the head and paper changes, and the ink landing position changes. An ink landing position shift amount depending on cockling depends on the printing medium, the amount of ink to be landed on the printing medium, the printing environment, the platen position, and the like.

An ink amount and platen position when printing a reference pattern and adjustment pattern can be grasped in advance. By grasping a printing medium and printing environment dependence in advance, a landing variation amount can be predicted. These pieces of information need not always be obtained in advance, and may be obtained before printing adjustment.

As described above, according to the first embodiment, an adjustment value for correcting an ink landing position is calculated based on information about an ink landing position at each position in the main scanning direction, and information about ink landing positions detected from a reference pattern and adjustment pattern. Based on the adjustment value, a controller 400 controls the driving timing (ink discharge timing) of the printing element of the printhead. Note that the ink landing position shift amount R may be obtained based on a plurality of factors mentioned above. For example, when both height variations (variations of the distance between the head and paper) and orientation variations of the carriage 1 are considered, it is also possible to obtain an ink landing position shift amount R1 arising from height variations and an ink landing position shift amount R2 arising from orientation variations of the carriage 1, and obtain the ink landing position shift amount R based on these values.

Accordingly, the ink landing position can be adjusted without increasing the number of patterns to be printed and without the influence of variations of the ink landing position depending on the printing position of the pattern in the main scanning direction. While suppressing the amount of ink used in adjustment of the ink landing position, the ink landing position adjustment accuracy can be increased.

Second Embodiment

The second embodiment will be described. The second embodiment will describe a case in which, in order to obtain information about an ink landing position at each position in the main scanning direction, a pattern regarding the ink landing position is printed and read to obtain the information. Note that a description of the same parts as those in the first embodiment will not be repeated.

Figure 8:
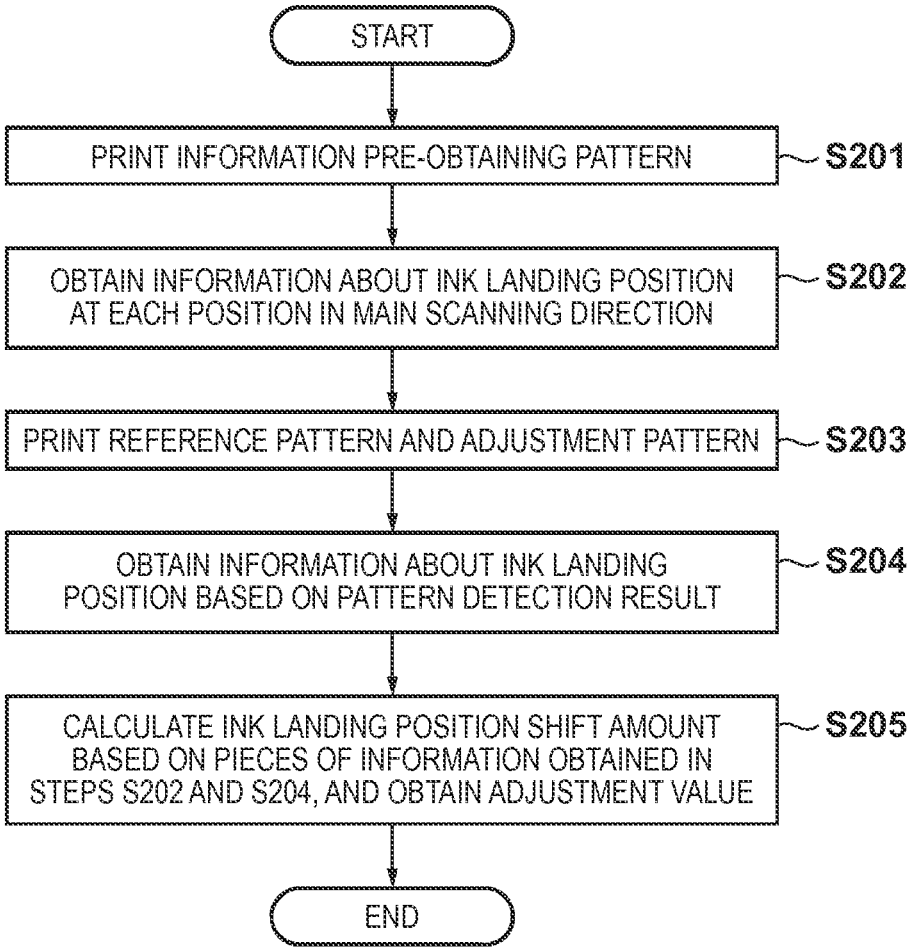
FIG. 8 is a flowchart exemplifying a processing sequence in the printing apparatus 10.

The sequence of printing position adjustment (ink landing position adjustment) processing in a printing apparatus 10 according to the second embodiment will be explained with reference to FIG. 8.

[Steps S201 and S202]

First, the printing apparatus 10 prints an information pre-obtaining pattern under the control of a CPU 401 in order to obtain information about an ink landing position at each position in the main scanning direction. Then, the CPU 401 detects the information pre-obtaining pattern using an optical sensor 30. As a result, the influence of the vibrational component of a carriage 1 and the influence of aging (which are not easy to estimate in advance) can be obtained.

Figure 9:
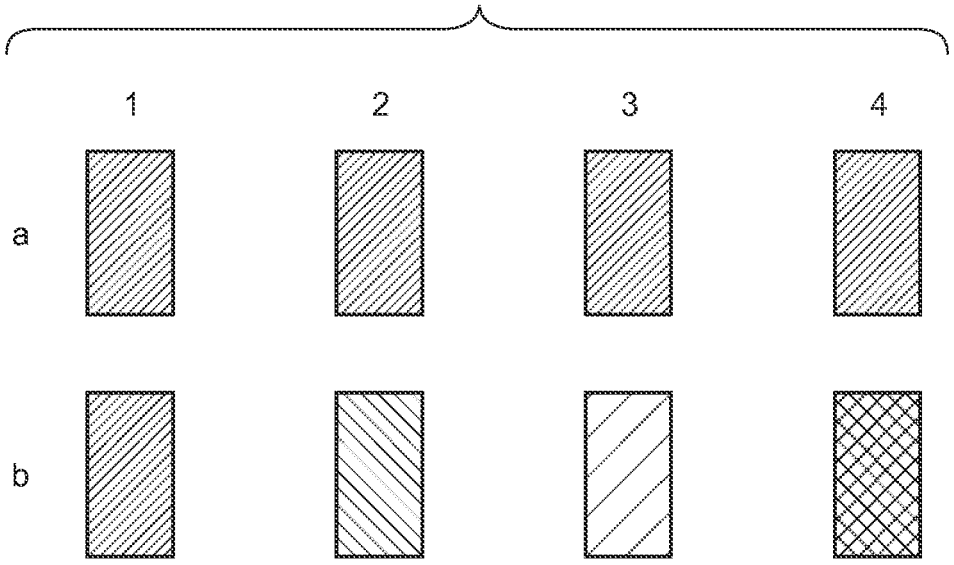
FIG. 9 is a view exemplifying an information pre-obtaining pattern.

FIG. 9 is a view exemplifying the information pre-obtaining pattern.

On columns 1 to 4 of row a, the printing apparatus 10 obtains information about an ink landing position at each position in the main scanning direction. Patterns on row a are printed using the same nozzles under the same printing conditions. In this case, the patterns are printed by the same print scanning using the reference nozzle array.

Then, the printing apparatus 10 adjusts the ink landing position based on patterns on row b. The printing apparatus 10 prints a pre-reference pattern represented on column 1 of row b using the reference nozzle array. Also, the printing apparatus 10 prints pre-adjustment patterns represented on columns 2 to 4 of row b using the adjustment nozzle array.

From this, the printing apparatus 10 obtains pieces of information about ink landing positions at respective positions in the main scanning direction that have been obtained from the patterns on row a, and the distances between the patterns in the pre-reference pattern and pre-adjustment patterns that have been obtained from the patterns on row b. Based on the obtained information, the printing apparatus 10 obtains an adjustment value for correcting an ink landing position. This method can correct even the shift amount of the detection unit upon orientation variations of the carriage 1.

[Steps S203 to S205]

Figure 5:
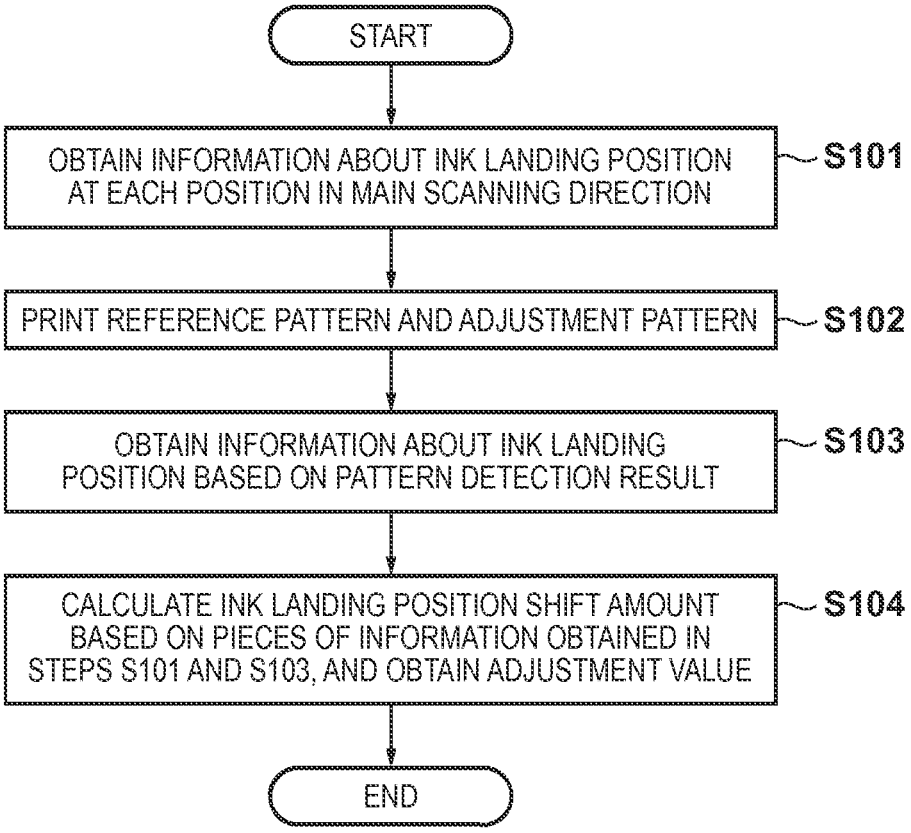
FIG. 5 is a flowchart exemplifying a processing sequence in the printing apparatus 10.

Subsequent processes are the same processes as those in steps S102 to S104 shown in FIG. 5 in the first embodiment.

As described above, according to the second embodiment, an information pre-obtaining pattern is printed, and information about an ink landing position at each position in the main scanning direction is obtained based on the detection result. Even in this case, the same effects as those in the above-described first embodiment can be obtained.

Third Embodiment

Printing position adjustment (ink landing position adjustment) processing according to the third embodiment will be explained. The third embodiment will describe a case in which an ink landing position at each position in the main scanning direction is adjusted first, and then an adjustment pattern is printed. Note that a description of the same parts as those in the first and second embodiments will not be repeated.

A processing sequence in a printing apparatus 10 according to the third embodiment will be explained with reference to FIG. 10. In the following description, an ink landing position shift between nozzles of different colors is adjusted.

[Step S301]

In the printing apparatus 10, first, a CPU 401 obtains information about an ink landing position at each position in the main scanning direction (first obtainment). When adjusting an ink landing position between nozzles of different colors, a reference pattern and adjustment pattern are printed by the same scanning, and thus the influence of variations between the head and paper weakens. However, the printing position in the main scanning direction differs between the reference pattern and the adjustment pattern, so the ink landing position is affected by orientation variations of a carriage 1 (see FIG. 7A).

Assume that an ink landing position shift amount upon orientation variations of the carriage 1 at a position where an adjustment pattern is printed using the adjustment nozzle array with respect to a position where a reference pattern is printed using the reference nozzle array is 20 μm. As described above, orientation variations of the carriage 1 depend on the accuracy of a main rail 8. Note that an ink landing position shift amount calculated from the accuracy of the main rail 8 is based on simple geometric calculation, and a description of a detailed calculation process will be omitted. When an ink landing position shift at each position in the main scanning direction is highly dependent on the distance between the head and paper, the method in step S101 described above may be employed.

[Step S302]

In the printing apparatus 10, the CPU 401 obtains information about an ink landing position at each position in the main scanning direction. In this case, information about an ink landing position at each position in the main scanning direction is obtained using a method different from that in step S301 (second obtainment). More specifically, similar to step S101, information about an ink landing position at each position in the main scanning direction is calculated based on the discharge speed, the distance between the head and paper, and the carriage speed.

In adjustment between nozzles of different colors, the distance between the head and paper, and the carriage speed are constant. In this case, assume that the discharge speed of the reference nozzle array is 18 m/s, and the discharge speed of an adjustment color is 16 m/s. An ink landing position shift amount at a predetermined position can be calculated according to equation (4):

$$Rf=h/v\times Vcr \quad (4)$$

Rf: ink landing position shift amount at a predetermined position, h: variation amount of the distance between the head and paper, v: discharge speed, Vcr: carriage speed Equation (4) is a formula in unidirectional printing, and is ½ of equation (1).

In this case, it can be predicted that the ink landing position shifts by "−9 μm" under the influence of the discharge speed.

[Step S303]

In the printing apparatus 10, the CPU 401 calculates an ink landing position shift amount at each position in the main scanning direction based on the information obtained in the processing of step S301 and the information obtained in the processing of step S302, and calculates an adjustment value for correcting the shift amount. Note that each adjustment value is calculated in correspondence with each position in the main scanning direction.

[Step S304]

In the printing apparatus 10, the CPU 401 controls a discharge operation by a printhead 60 via a head driver 440. In response to this, the printhead 60 discharges ink, printing a reference pattern. At a discharge timing to which the adjustment value calculated in the processing of step S303 is applied, the printhead 60 discharges ink, printing an adjustment pattern.

In this case, the ink landing position shift amount at the predetermined position in the main scanning direction that has been calculated in the processing of step S301 is 20 μm, and the ink landing position shift amount at the predetermined position in the main scanning direction that has been calculated in the processing of step S302 is "−9 μm". Thus, the final shift amount is 11 μm. More specifically, when an adjustment pattern is printed using the adjustment nozzle array, the 11 μm ink landing position shift is generated at the position.

To prevent this, the printing apparatus 10 prints the adjustment pattern at a specific distance from the reference pattern printing position under the control of the CPU 401. Although the reference pattern and adjustment pattern are originally printed at a predetermined distance, the adjustment pattern is printed at a position of −11 μm further spaced apart from the reference pattern position.

[Step S305]

In the printing apparatus 10, the CPU 401 detects the adjustment pattern and reference pattern using an optical sensor 30 and confirms, based on the detection result, whether the distance between the two patterns is a predetermined distance. If the distance between the two patterns is the predetermined distance, the printing apparatus 10 ends the processing.

In this manner, an ink landing position shift at each position in the main scanning direction is corrected in advance, and then an adjustment pattern is printed. The adjustment pattern can be printed on the printing medium in a state in which the ink landing position shift in the main scanning direction has been corrected. For example, the position of the suction port in the platen can be avoided, reducing the influence of cockling.

[Step S306]

If the distance between the patterns is not the predetermined distance as a result of the confirmation in step S305, the ink landing position shifts. Thus, in the printing apparatus 10, the CPU 401 calculates an ink landing position shift amount based on the distance between the patterns, obtaining an adjustment value. Note that the printing apparatus 10 corrects an ink landing position shift by adjusting the timing of discharge from the adjustment nozzle array based on the adjustment value.

As described above, according to the third embodiment, an ink landing position at each position in the main scanning direction is adjusted in advance, and then an adjustment pattern or the like is printed. Even in this case, the same effects as those in the first embodiment can be obtained.

Figure 10:
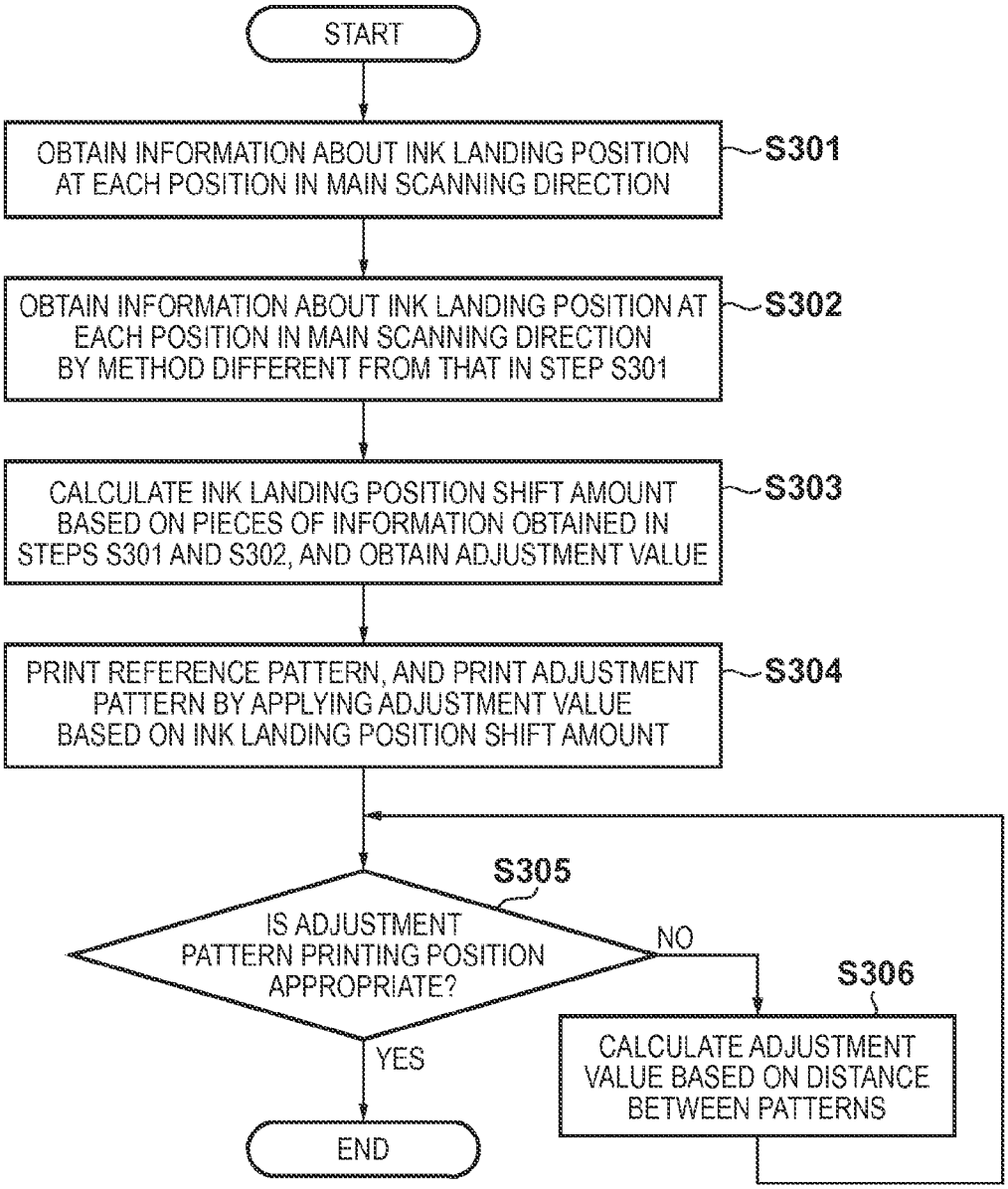
FIG. 10 is a flowchart exemplifying a processing sequence in the printing apparatus 10.

Note that the processes in steps S301 and S302 shown in FIG. 10 suffice to obtain information about an ink landing position at each position in the main scanning direction, and are not limited to the above example. More specifically, information about an ink landing position at each position in the main scanning direction is obtained by properly combining the variation amount of the distance between the head and paper, the variation amount of the carriage orientation, the variation amount of the paper surface state by cockling, and a variation amount detected from an information pre-obtaining pattern in accordance with factors and the like considered to have a great influence.

In the above description, information about an ink landing position at each position in the main scanning direction (variation amount of the carriage orientation or variation amount of the distance between the head and paper) is obtained according to two methods by performing the processes in steps S301 and S302. However, the present invention is not limited to this. For example, information about an ink landing position at each position in the main scanning direction may be obtained by one method, or three or more methods.

Fourth Embodiment

Printing position adjustment (ink landing position adjustment) processing according to the fourth embodiment will be explained. In the fourth embodiment, the first discharge timing is determined based on information about an ink landing position at each position in the main scanning direction, and the distance between patterns in a reference pattern and adjustment pattern. The second discharge timing is determined from patterns printed at the first discharge timing. Note that a description of the same parts as those in the first to third embodiments will not be repeated.

To implement higher image quality, there are problems which cannot be solved by only detecting the distance between patterns. For example, when the pattern printing position is changed, the influence of overlay printing cannot be corrected. Also, overlay printing of inks of different colors at the same position generates the influence of smear on the printing medium.

Further, an ink droplet contains a satellite component in addition to a main droplet component. When detecting a distance between patterns, the landing position of the main droplet component is detected and corrected, but the satellite component is hardly considered.

To solve these problems, the fourth embodiment executes primary adjustment (coarse adjustment) based on detection of the distance between patterns, and secondary adjustment (fine adjustment) based on overlay of printing patterns.

Figure 11A:
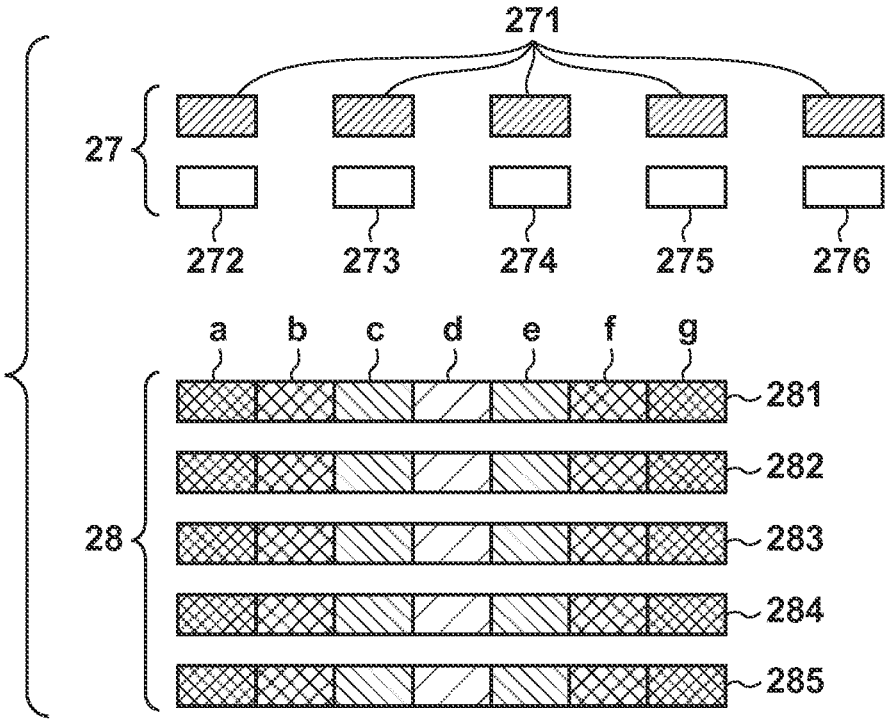
FIGS. 11A and 11B are views exemplifying a distance detection pattern and overlay detection pattern.
Figure 11B:
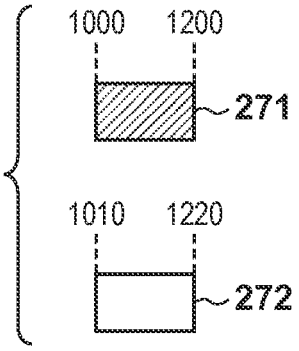

A distance detection pattern and overlay detection pattern which are printed on a printing medium will be exemplified with reference to FIGS. 11A and 11B. The overlay detection pattern will also be referred to as a density detection pattern. In FIG. 11A, reference numeral 27 denotes a distance detection pattern group; and 28, a phase-shifted overlay detection pattern group. These patterns are printed in the same direction. Patterns 271 in the distance detection pattern group 27 are printed using reference nozzle arrays. Patterns 272 to 276 in the distance detection pattern group 27 are printed using the adjustment nozzle arrays (nozzle arrays to be adjusted). The pattern 272 is printed using the first adjustment nozzle array. The pattern 273 is printed using the second adjustment nozzle array. The pattern 274 is printed using the third adjustment nozzle array. The pattern 275 is printed using the fourth adjustment nozzle array. The pattern 276 is printed using the fifth adjustment nozzle array.

Overlay detection pattern groups 28 include overlay detection patterns 281 to 285. Each of the overlay detection patterns 281 to 285 is formed from seven patterns a to g. Each of the patterns a to g is set so that a pattern having a maximum density changes depending on the shift amount of the position of a printed dot.

The overlay detection pattern 281 is formed from patterns which are overlaid and printed by the reference nozzle array and first adjustment nozzle array. The overlay detection pattern 282 is formed from patterns which are overlaid and printed by the reference nozzle array and second adjustment nozzle array. The overlay detection pattern 283 is formed from patterns which are overlaid and printed by the reference nozzle array and third adjustment nozzle array. The overlay detection pattern 284 is formed from patterns which are overlaid and printed by the reference nozzle array and fourth adjustment nozzle array. The overlay detection pattern 285 is formed from patterns which are overlaid and printed by the reference nozzle array and fifth adjustment nozzle array.

In the overlay detection pattern group 28, the overlay reference pattern and overlay adjustment pattern are printed to be adjacent to each other in the main scanning direction in the order of a to g, as shown in FIG. 11A. When the printing positions of the overlap reference pattern and overlay adjustment pattern overlap each other in the main scanning direction, the density on the paper surface becomes low. As the overlap decreases, the density relatively increases. This is because the non-printing portion on the paper surface decreases as the ink landing overlap decreases. In adjustment of the ink landing position by overlay of patterns, this density difference is detected.

Figure 12A:
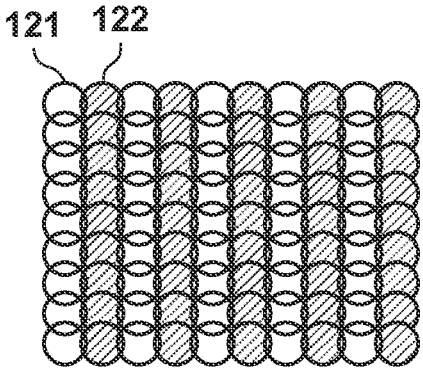
FIGS. 12A to 12C are views exemplifying an overlay detection pattern.
Figure 12B:
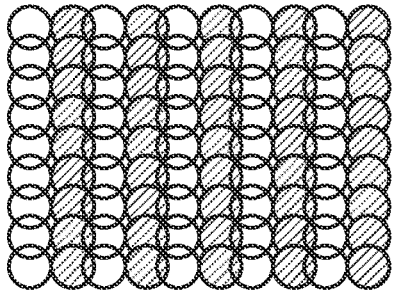
Figure 12C:
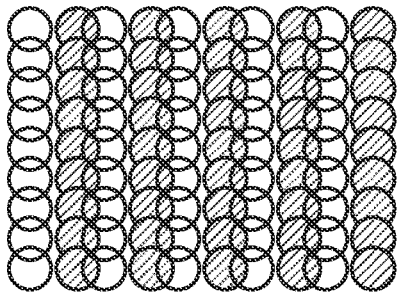

FIGS. 12A to 12C are schematic views for explaining an overlay detection pattern. In FIGS. 12A to 12C, an outline dot 121 is a dot printed by the reference nozzle array. A hatched dot 122 is a dot printed by the adjustment nozzle array. For example, FIG. 12A shows the overlay detection pattern a in FIG. 11A. FIG. 12B shows the overlay detection pattern b in FIG. 11A. FIG. 12C shows the overlay detection pattern c in FIG. 11A. As the dot overlap increases, the unprinted area increases. As a result, the average density of the pattern decreases. As shown in FIGS. 12A to 12C, the overlay detection pattern is set to change the dot position by an amount smaller than the size of one dot. By comparing the densities of the seven patterns a to g in FIG. 11A, adjustment of smaller than one dot can be performed.

Figure 13:
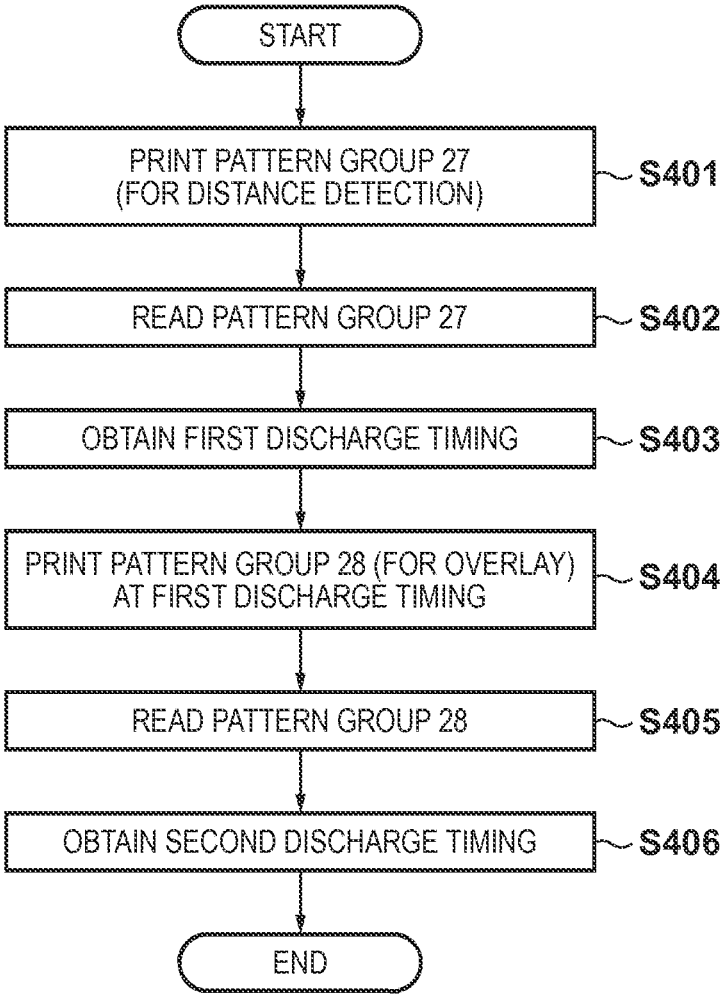
FIG. 13 is a flowchart exemplifying a processing sequence in the printing apparatus 10.

A processing sequence in a printing apparatus 10 according to the fourth embodiment will be exemplified with reference to FIG. 13.

[Steps S401, S402, and S403]

In step S401, the distance detection pattern group 27 is printed. In step S402, the distance detection patterns 271 to 276 are detected using an optical sensor 30. In step S403, the first discharge timing is obtained based on the detection result from the optical sensor 30. Obtainment of the timing of the first adjustment nozzle array will be explained using the distance detection patterns 271 and 272 in FIG. 11B. An encoder position (slit count) when the left end of the distance detection pattern 271 is detected is 1000, and an encoder position (slit count) when the right end of the distance detection pattern 271 is detected is 1200. Similarly, an encoder position (slit count) when the left end of the distance detection pattern 272 is detected is 1010, and an encoder position (slit count) when the right end of the distance detection pattern 272 is detected is 1220. In this case, the position difference for the left end is 10, and that for the right end is 20. The average value "15" of these values (10 and 20) is set as a discharge timing adjustment amount (correction value) in consideration of the influence of smear based on pattern formation conditions. In this way, the discharge timing adjustment amount (correction value) is obtained based on the encoder resolution.

[Steps S404, S405, and S406]

In step S404, the overlay detection pattern group 28 is printed at the first discharge timing. In step S405, the overlay detection patterns 281 to 284 are detected using the optical sensor 30. In step S406, the second discharge timing is obtained based on the detection result from the optical sensor 30.

Adjustment based on the distance detection pattern (for implementing adjustment in a wide range using a small printing region) is first executed as coarse adjustment. In this processing, the ink landing position adjustment value is calculated in correspondence with each position in the main scanning direction in order to increase the adjustment value calculation accuracy.

In adjustment based on the overlay detection pattern, the printing pattern amount is determined from an adjustment resolution and a range necessary for adjustment. By increasing the adjustment accuracy of coarse adjustment and narrowing the range necessary for adjustment, the printing pattern amount can be reduced.

The overlay detection pattern is printed to perform adjustment considering smear upon ink landing and the satellite component. The overlay detection pattern is printed at a discharge timing obtained by coarse adjustment.

As the overlay detection pattern, the overlay reference pattern and overlay adjustment pattern are printed as described above. The printing method is desirably executed under the same printing conditions as those in actual image printing.

The overlay adjustment pattern is printed using the adjustment nozzle array at the first discharge timing detected in coarse adjustment. The second discharge timing detected based on the density difference in the overlay detection pattern group 28 is determined (redetermined) as a fine adjustment value. An ink landing position shift is corrected by discharging ink from the adjustment nozzle array at the second discharge timing. This implements image printing adjusted at high accuracy.

As described above, according to the fourth embodiment, after adjustment based on the distance detection pattern is executed as coarse adjustment, fine adjustment by overlay of printing patterns is executed. Thus, adjustment can be performed at an accuracy higher than the encoder resolution. The fourth embodiment can increase the ink landing position adjustment accuracy much more than in the first embodiment. High-quality image formation can therefore be implemented in an actual printing operation of printing based on image data after executing printing position adjustment processing.

Representative embodiments of the present invention have been exemplified. However, the present invention is not limited to the above embodiments illustrated in the drawings, and can be properly modified and practiced without departing from the scope of the invention. Note that a nozzle array to be adjusted is a nozzle array different from a reference nozzle array. However, for example, when bidirectional printing (printing in the forward direction and printing in the reverse direction) is performed, a reference nozzle array used to perform printing in the reverse direction is handled as an adjustment nozzle array. The reference nozzle array is scanned in the reverse direction to print an adjustment pattern, similar to another adjustment nozzle array. Thus, ink landing positions in the two directions can also be adjusted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-183077, filed Aug. 24, 2011, which is hereby incorporated by reference herein in its entirety.

What is claimed is:

1. A printing apparatus comprising:

a printhead provided with a first nozzle array and a second nozzle array for discharging ink onto a printing medium, wherein the first nozzle array and the second nozzle array are arranged in a predetermined direction;

a scanning unit configured to scan the printhead in the predetermined direction;

a first obtaining unit configured to obtain, for each of a plurality of positions on the printing medium in the predetermined direction, first information about a shift amount, in the predetermined direction, between a printing position of ink discharged from the first nozzle array and a printing position of ink discharged from the second nozzle array;

a print control unit configured to cause the printhead to print a first distance detection pattern on the printing medium by discharging ink from the first nozzle array and to print a second distance detection pattern at a position spaced apart from the first distance detection pattern in the predetermined direction by discharging ink from the second nozzle array;

a second obtaining unit configured to obtain, based on the first distance detection pattern and the second distance detection pattern, second information about a distance between a printing position of the first distance detection pattern and a printing position of the second distance detection pattern; and a determination unit configured to determine, based on the first information obtained by the first obtaining unit and the second information obtained by the second obtaining unit, a relative ink discharge timing between the first nozzle array and the second nozzle array in the scanning by the scanning unit, by correcting the distance between the printing position of the first distance detection pattern and the printing position of the second distance detection pattern which is indicated by the second information obtained by the second obtaining unit using the first information obtained by the first obtaining unit.

2. The apparatus according to claim 1, wherein the first information contains one of:

variation information of a distance between the printhead and the printing medium in the predetermined direction, variation information of an orientation of the printhead in the predetermined direction, and variation information of a surface state of the printing medium in the predetermined direction upon printing with ink on the printing medium.

3. A printing apparatus comprising:

a printhead provided with a first nozzle array and a second nozzle array for discharging ink onto a printing medium, wherein the first nozzle array and the second nozzle array are arranged in a predetermined direction;

a scanning unit configured to scan the printhead in the predetermined direction;

a print control unit configured to cause the printhead:

to perform first print control of printing a first distance detection pattern on the printing medium by discharging ink from the first nozzle array and to print a second distance detection pattern at a different position in a direction intersecting the predetermined direction with respect to a printing position of the first distance detection pattern by discharging ink from the second nozzle array, and to perform second print control of printing a first density detection pattern by discharging ink from the first nozzle array and to print a second density detection pattern by discharging ink from the second nozzle array, at printing positions different from the printing positions of the first distance detection pattern and the second distance detection pattern;

a reading control unit configured to perform first reading control of reading the first distance detection pattern and the second distance detection pattern, and second reading control of reading the first density detection pattern and the second density detection pattern;

an obtaining unit configured to obtain a discharge timing of the second nozzle array in the second print control based on a result of reading in the first reading control; and a determination unit configured to determine a relative ink discharge timing between the first nozzle array and the second nozzle array in the scanning by the scanning unit, by correcting a distance between the printing positions of the first distance detection pattern and the second distance detection pattern using a result of reading in the second reading control.

4. The apparatus according to claim 3, wherein in the second print control, a plurality of first density detection patterns and a plurality of second density detection patterns are printed in the predetermined direction to change an overlapping amount between dots of the first density detection pattern and dots of the second density detection pattern.

5. A method of controlling a printing apparatus, the printing apparatus including a printhead provided with a first nozzle array and a second nozzle array for discharging ink onto a printing medium, wherein the first nozzle array and the second nozzle array are arranged in a predetermined direction, and a scanning unit configured to scan the printhead in the predetermined direction, the control method comprising:

obtaining, for each of a plurality of positions on the printing medium in the predetermined direction, first information about a shift amount, in the predetermined direction, between a printing position of ink discharged from the first nozzle array and a printing position of ink discharged from the second nozzle array;

causing the printhead to print a first distance detection pattern on the printing medium by discharging ink from the first nozzle array, and printing a second distance detection pattern at a printing position different from a printing position of the first distance detection pattern in the predetermined direction by discharging ink from the second nozzle array;

obtaining, based on the first distance detection pattern and the second distance detection pattern, second information about a distance between the printing position of the first distance detection pattern and the printing position of the second distance detection pattern; and determining, based on the first information and the second information, a relative ink discharge timing between the first nozzle array and the second nozzle array in the scanning by the scanning unit, by correcting the distance between the printing position of the first distance detection pattern and the printing position of the second distance detection pattern using the first information.

6. The apparatus according to claim 1, further comprising a reading unit configured to measure a distance between the printhead and the printing medium for each of the plurality of positions, wherein the first obtaining unit obtains information relating to the distance between the printhead and the printing medium for each of the plurality of positions as the first information based on the measurement result by the reading unit.

7. The apparatus according to claim 1, wherein the first nozzle array and the second nozzle array discharge ink dots whose colors are different from each other.

8. The apparatus according to claim 3, further comprising a reading unit configured to measure a distance between the printhead and the printing medium for each of a plurality of printing positions, wherein the result of reading in the first reading control includes the distance between the printhead and the printing medium for each of the plurality of printing positions.

9. The apparatus according to claim 3, wherein the first nozzle array and the second nozzle array discharge ink dots whose colors are different from each other.

10. The apparatus according to claim 1, wherein the first obtaining unit obtains the first information based on a pattern printed for obtaining the first information.

11. The apparatus according to claim 1, further comprising a memory storing the first information, wherein the first information is stored in the memory in assembly of the apparatus, and the first obtaining unit obtains the first information stored in the memory.

12. A printing apparatus comprising:

a printhead provided with a first nozzle array and a second nozzle array for discharging ink onto a printing medium, wherein the first nozzle array and the second nozzle array are arranged in a predetermined direction;

a scanning unit configured to scan the printhead in the predetermined direction;

a first obtaining unit configured to obtain first information on a distance between the printhead and the printing medium for each of a plurality of positions of the printing medium in the predetermined direction, a print control unit configured to cause the printhead to print a first distance detection pattern on the printing medium by discharging ink from the first nozzle array and to print a second distance detection pattern at a position spaced apart from the first distance detection pattern in the predetermined direction by discharging ink from the second nozzle array;

a second obtaining unit configured to obtain, based on the first distance detection pattern and the second distance detection pattern, second information about a distance between a printed position of the first distance detection pattern and a printed position of the second distance detection pattern; and a determination unit configured to determine, based on the first information obtained by the first obtaining unit and the second information obtained by the second obtaining unit, a relative ink discharge timing between the first nozzle array and the second nozzle array in the scanning by the scanning unit, by correcting the distance between the printed position of the first distance detection pattern and the printed position of the second distance detection pattern which is indicated by the second information obtained by the second obtaining unit using the first information obtained by the first obtaining unit.

13. A printing apparatus comprising:

a printhead provided with a first nozzle array and a second nozzle array for discharging ink onto a printing medium, wherein the first nozzle array and the second nozzle array are arranged in a predetermined direction;

a scanning unit configured to scan the printhead in the predetermined direction;

a first obtaining unit configured to obtain, for each of a plurality of positions of the printing medium in the predetermined direction, first information about a shift amount, in the predetermined direction, between a printed position of ink discharged from the first nozzle array and a printed position of ink discharged from the second nozzle array;

a print control unit configured to cause the printhead to print a first distance detection pattern on the printing medium by discharging ink from the first nozzle array and to print a second distance detection pattern at a position spaced apart from the first distance detection pattern in the predetermined direction by discharging ink from the second nozzle array;

a second obtaining unit configured to obtain, based on the first distance detection pattern and the second distance detection pattern, second information about a distance between a printed position of the first distance detection pattern and a printed position of the second distance detection pattern; and a determination unit configured to determine, based on the first information obtained by the first obtaining unit and the second information obtained by the second obtaining unit, a relative ink discharge timing between the first nozzle array and the second nozzle array in the scanning by the scanning unit for at least one of the plurality of positions.

14. The apparatus according to claim 13, wherein the determination unit determines the relative ink discharge timing between the first nozzle array and the second nozzle array in the scanning by the scanning unit for each of the plurality of positions, based on the first information obtained by the first obtaining unit and the second information obtained by the second obtaining unit.

15. The apparatus according to claim 13, wherein the determination unit determines the relative ink discharge timing between the first nozzle array and the second nozzle array in the scanning by the scanning unit for the at least one of the plurality of positions, based on the first information obtained by the first obtaining unit and the second information obtained by the second obtaining unit, by correcting the distance between the printed position of the first distance detection pattern and the printed position of the second distance detection pattern indicated by the second information obtained by the second obtaining unit using the first information obtained by the first obtaining unit.

16. The apparatus according to claim 13, further comprising an image print control unit configured to cause the printhead to print an image on the printing medium using the first nozzle array and the second nozzle array based on the relative ink discharge timing determined by the determining unit.

17. The apparatus according to claim 13, further comprising a reading unit configured to measure a distance between the printhead and the printing medium for each of the plurality of positions, wherein the first obtaining unit obtains information relating to the distance between the printhead and the printing medium for each of the plurality of positions as the first information based on the measurement result by the reading unit.

18. The apparatus according to claim 13, wherein the first nozzle array and the second nozzle array discharge ink dots whose colors are different from each other.

19. The apparatus according to claim 13, wherein the first obtaining unit obtains the first information based on a pattern printed for obtaining the first information.

20. The apparatus according to claim 13, further comprising a memory storing the first information, wherein the first information is stored in the memory in assembly of the apparatus, and the first obtaining unit obtains the first information stored in the memory.

21. A printing apparatus comprising:

a printhead provided with a nozzle array for discharging ink onto a printing medium;

a scanning unit configured to reciprocally scan the printhead in a predetermined direction;

a first obtaining unit configured to obtain, for each of a plurality of positions of the printing medium in the predetermined direction, first information about a shift amount, in the predetermined direction, between a printed position of ink discharged from the nozzle array in a forward direction in a scanning by the scanning unit and a printed position of ink discharged from the nozzle array in a backward direction in a scanning by the scanning unit;

a print control unit configured to cause the printhead to print a first distance detection pattern on the printing medium by discharging ink from the nozzle array in the forward direction in a scanning by the scanning unit and to print a second distance detection pattern at a position spaced apart from the first distance detection pattern in the predetermined direction by discharging ink from the nozzle array in the backward direction in a scanning by the scanning unit;

a second obtaining unit configured to obtain, based on the first distance detection pattern and the second distance detection pattern, second information about a distance between a printed position of the first distance detection pattern and a printed position of the second distance detection pattern; and a determination unit configured to determine, based on the first information obtained by the first obtaining unit and the second information obtained by the second obtaining unit, a relative ink discharge timing of the nozzle array between a forward direction scanning and a backward direction scanning for at least one of the plurality of positions.

* * * * *